United States Patent [19]

Riikonen

[11] 4,231,585

[45] Nov. 4, 1980

[54] SKI FASTENING

[76] Inventor: Pentti Riikonen, Kiveriönkatu 12 B 48, 15210 Lahti 21, Finland

[21] Appl. No.: 960,634

[22] Filed: Nov. 14, 1978

[30] Foreign Application Priority Data

Nov. 18, 1977 [FI] Finland ..... 773503

[51] Int. Cl.[3] ..... A63C 9/10

[52] U.S. Cl. ..... 280/615

[58] Field of Search ..... 280/614, 615, 623, 626, 280/631, 632, 634

[56] References Cited

U.S. PATENT DOCUMENTS

| | | | |
|---|---|---|---|
| 2,516,238 | 7/1950 | Mortsell | 280/615 |
| 4,043,570 | 8/1977 | Riikonen | 280/615 |
| 4,146,247 | 3/1979 | Johansson et al. | 280/615 |

*Primary Examiner*—John J. Love

*Assistant Examiner*—Michael Mar

*Attorney, Agent, or Firm*—Toren, McGeady and Stanger

[57] ABSTRACT

A ski fastening including a base plate, with upwardly directed integral side plates along both sides, the upper margins of these side plates pointing toward each other for supporting the sole of a ski shoe. The base plate carrying a swivellably attached clamping yoke having upwardly bent ends at the rearwardly pointing legs of the yoke. The upwardly bent ends arranged to engage from below in holes provided in the sole of the skiing shoe and the yoke being securable in position by the aid of a bar located on the foremost part of the base plate. The yoke is swivellably attached to the base plate at the point of angulation of the yoke's upwardly bent ends so that, on fastening the skiing shoe, the upwardly bent ends of the yoke will urge the shoe forwardly, whereby its sole is impacted or held between the side plates.

2 Claims, 2 Drawing Figures

SKI FASTENING

Ski fastenings of this type are known in the prior art to have the drawback that at the clamping of the shoe, the gripping members, that is the upwardly bent ends of the clamping yoke, do not press the shoe to be immovable in the ski fastening, but instead merely hold the sole of the shoe, whereby under laterally acting forces the shoe may turn sidewise. In the course of time the sides of the sole and the holes in the sole will be subject to wear and become loose to such an extent that the lateral movements of the skiing shoe when skiing are annoying.

The object of the present invention is to eliminate the drawbacks mentioned and to provide a ski fastening of a new type, wherein the skiing shoe is positively held in position, and straight, in spite of the forces generated by skiing.

The ski fastening of the invention is characterized in that the yoke is swivellably connected to the base plate at the point where the upwardly bent ends of the yoke have been angulated so that, as the skiing shoe is being fixed, the upwardly bent ends of the yoke will urge the shoe forwardly, whereby its sole is wedged in between the side plates. Consequently, the shoe is firmly held in position in spite of lateral forces. The sides of the sole will not wear down because they cannot move in the fastening or rub between the side plates of the fastening.

A favourable embodiment of the invention is characterized in that the rearwardly pointing legs of the yoke have been bent against and towards each other to constitute turning axles and the free ends of the turning axles have been bent upwardly to become gripping members. The yoke will therefore be firmly held in position in the respective depressions provided for the turning axles of the yoke in the base plate.

Another embodiment of the invention is characterized in that the top margins of the side plates have been mutually connected to form a bracing bridge. This bracing bridge prevents the front edge of the sole of the skiing shoe from rising up, and at the same time it braces the upwardly bent side plates of the ski fastening against the wedging forces produced by the sole.

A third embodiment of the invention is characterized in that there are metallic bushings in the holes in the sole of the skiing shoe. Therefore, the margins of the holes will not fail even under heavy loading.

Figure 1:
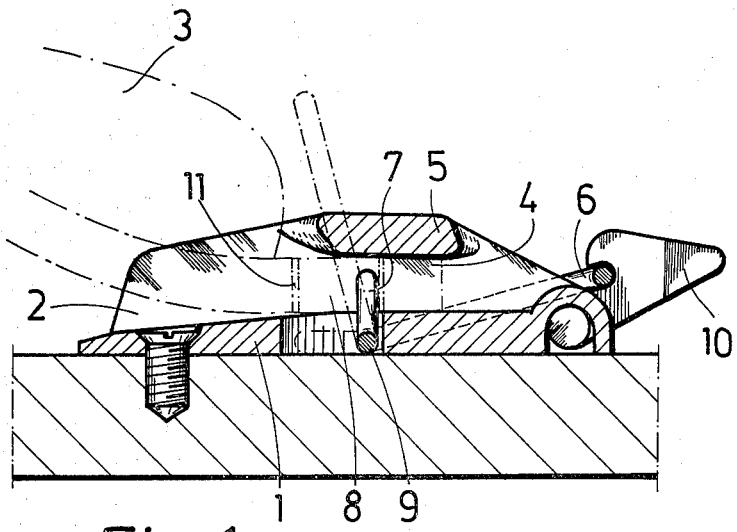

The invention is described in the following with the aid of an example and with reference to the attached drawing, wherein:

FIG. 1 presents the ski fastening of the invention in elevational view and in section.

Figure 2:
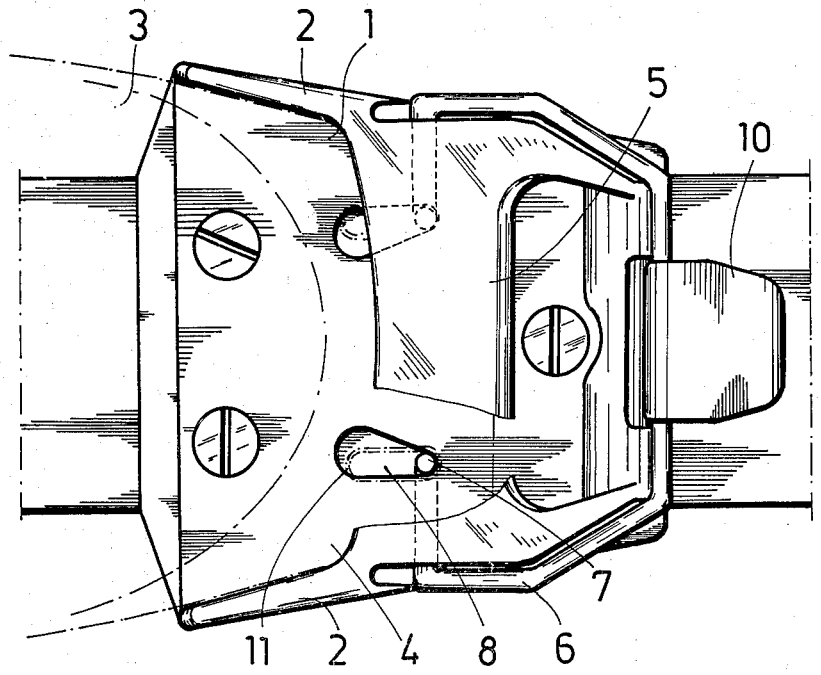

FIG. 2 shows the same ski fastening as FIG. 1, but viewed from above and partly broken away.

The ski fastening consists of the base plate 1, having on either side the upwardly directed side plates 2, the top margins of these side plates having been mutually connected by the bracing bridge 5 for laterally support the sole 4 of the skiing shoe 3. To the base plate 1 the clamping yoke 6 has been swivellably attached, the upwardly bent ends 7 of this yoke's rearwardly pointing legs engaging from below in the holes 8 provided in the tip portion of the sole 4 of the skiing shoe 3. The yoke 6 has been swivellably affixed so that on fixing to the skiing shoe 3 the upwardly bent ends 7 of the yoke will urge the shoe forwardly, whereby its sole 4 is wedged between the side plates 2. The rearwardly pointing legs of the yoke 6 have been bent against and towards each other to serve as turning axles 9, the free ends of these axles having been turned upwardly to constitute gripping members 7. The yoke 6 is securable in an immovable position with the aid of the bar means 10 on the foremost part of the base plate 1. Metallic bushings 11 have been provided in the holes 8 in the sole 4 of the skiing shoe 3.

The affixing procedure of the skiing shoe 3 to the ski fastening is as follows. The clamping yoke 6 of the ski fastening is held in its raised position, indicated by dotted lines in FIG. 1, whereby the gripping members 7 are directed rearwardly, in the depressions in the base plate 1 of the ski fastening. The skiing shoe 3, which has holes 8 in the tip portion 4 of its sole, is pushed into the fastening, in between the side plates 2. The yoke 6 is turned forwardly into the clamping position, whereby the gripping members rise, turning about their turning axles 9 and urging the skiing shoe by the holes 8 in the sole firmly in between the side plates. The bracing bridge 5 connecting the top margins of the side plates 2 prevents the tendency of the sole 4 of the skiing shoe 3 to rise upwardly. The yoke 6 is secured with the bar means 10. Since the skiing shoe 3 is urged into the ski fastening in the way just described, the shoe will not be subject to fatigue, not even under lateral stresses, to the extent that its fastening would become loose in the course of time: in contrast, the shoe is always held in place, well-clamped and safe.

It is obvious to a person skilled in the art that various embodiments of the invention may vary within the scope of the claims following below. For instance, the skiing shoe must not necessarily have a long, forwardly directed sole with piercing holes as shown in the figure: it is equally proper if the tip portion of the shoe presents depressions for the gripping members. On the other hand, the holes or depressions may also lie considerably farther to the rear than has been shown in the drawing.

I claim:

1. Improvement in a ski fastening comprising a base plate with upwardly directed side plates on both sides thereof, the top margins of said side plates being directed toward each other for supporting the sole of the skiing shoe, and a clamping yoke swivellably mounted on said base plate, said yoke having upwardly bent ends for entering, from below, holes provided in the sole of the skiing shoe, and bar means on the foremost portion of the base plate for securing said yoke in clamping position, wherein the improvement comprises that said yoke being swivellably attached to said base plate at the point of angulation of said upwardly bent ends so that on fastening the skiing shoe said upwardly bent ends of said yoke will urge the shoe forwardly so that its sole is impacted between said side plates, and the top margins of said side plates being mutually connected to form a bracing bridge.

2. Improvement in a ski fastening, as set forth in claim 1, including a metallic bushing arranged in each hole in the sole of the skiing shoe.

* * * * *